US007729651B2

(12) United States Patent
Poxon et al.

(10) Patent No.: US 7,729,651 B2
(45) Date of Patent: Jun. 1, 2010

(54) AXIALLY TRANSLATING WEB CLEANING SYSTEM FOR A FUSER

(75) Inventors: John Poxon, Stevenage (GB); Nicholas Baxter, Welwyn Garden (GB); Ian Pitts, Cambs (GB); Pieter Mulder, Welwyn Garden (GB); Martin Callis, Hemel Hempstead (GB); Riley Brede, Welwyn Garden (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/314,904

(22) Filed: Dec. 21, 2005

(65) Prior Publication Data

US 2007/0140757 A1 Jun. 21, 2007

(51) Int. Cl.
*G03G 15/20* (2006.01)

(52) U.S. Cl. ..... 399/327; 399/343

(58) Field of Classification Search ..... 399/327, 399/122–123

See application file for complete search history.

(56) References Cited

U.S. PATENT DOCUMENTS 4,556,890 A * 12/1985 Hermanson et al. ..... 346/74.4
4,853,741 A 8/1989 Ku
5,049,944 A 9/1991 DeBolt et al.
5,200,785 A 4/1993 Hoover et al.
3,831,553 A 8/1994 Thettu
5,519,914 A * 5/1996 Egan ..... 15/256.53
5,842,418 A * 12/1998 Corrado et al. ..... 101/425
5,850,588 A * 12/1998 Yoshikawa ..... 399/327
6,305,636 B1 * 10/2001 Satoh et al. ..... 242/538.2
6,490,423 B2 12/2002 Horobin et al.
6,532,353 B1 3/2003 Orchard et al.
6,804,488 B2 * 10/2004 Matsumoto ..... 399/327
6,876,832 B2 4/2005 Pirwitz et al.

FOREIGN PATENT DOCUMENTS

JP 02205881 A * 8/1990

* cited by examiner

*Primary Examiner*—David M Gray
*Assistant Examiner*—Geoffrey T Evans
(74) *Attorney, Agent, or Firm*—Fay Sharpe LLP

(57) ABSTRACT

A web cleaning system for a fuser system includes a web which is biased into contact with a rotating cylindrical member, such as a fuser roll, as the fuser roll is rotated about its axis of rotation. A lateral displacement system displaces the web, relative to the cylindrical member, in a direction parallel to the axis of rotation of the cylindrical member. In this way, regions of the web which have become contaminated with collected toner are shifted laterally, thus avoiding oversaturation of the web.

20 Claims, 4 Drawing Sheets

AXIALLY TRANSLATING WEB CLEANING SYSTEM FOR A FUSER

BACKGROUND

The present exemplary embodiment relates to a cleaning system for a cylindrical roller and, more particularly, to a fuser apparatus for an electrophotographic printing device which includes a cleaning system for cleaning the fuser roll of toner particles. It will be appreciated, however, that the web cleaning system finds application in the cleaning or in liquid application treatment of other cylindrical rollers.

In typical electrophotographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises pigmented toner particles adhering triboelectrically to carrier granules, which is often referred to simply as toner. The developed image is subsequently transferred to the print medium, such as a sheet of paper. The fusing of the toner image onto paper is generally accomplished by applying heat and pressure. A typical fuser assembly includes a fuser roll and a pressure roll, which define a nip therebetween. The side of the paper having the toner image typically faces the fuser roll, which is often supplied with a heat source, such as a resistance heater, at its core. The combination of heat from the fuser roll and pressure between the fuser roll and the pressure roll fuses the toner image to the paper, and once the fused toner cools, the image is permanently fixed to the paper.

Fuser assemblies typically include a cleaning system by which the fuser roll can be automatically cleaned and/or supplied with a lubricant or release agent. In some cleaning devices, a cloth web is urged against the surface of the fuser roll by a spring loaded foam tension roll at a location generally away from the nip formed by the pressure and fuser rolls. The web provides a textured surface for removing particles of toner that remained on the fuser roll after the paper with the toner image has passed through the fuser. The web may also be impregnated to provide amounts of lubricant or release agent to the fuser roll. Release agents generally function to prevent sheets of paper from sticking to the surface of the fuser roll, thus causing a paper jam. The release agents may also serve to minimize the amount of toner that sticks to the fuser roll. After a predetermined number of reproductions have been printed, the web is advanced a few millimeters from a supply roll towards an uptake roll to provide a clean web surface in contact with the surface to be cleaned.

Where high volumes of similar images or high area coverage images are to be printed and fused, there is a tendency for toner to build up on the web and hamper subsequent cleaning of the fuser roll. The problem of short term web saturation is particularly apparent in printing of electronic documents, which have the same layout and spacing so that image lines (e.g., from email headers, text lines, and tables) form layouts and halftone dot patterns where the image is laid down on the sheet with a high accuracy in registration. The toner on a saturated web may be transferred back to the fuser roll and be deposited on a subsequent sheet. This can cause visible defects in the printed copies. Spots and strings of toner can also be deposited on the stripper fingers and temperature sensors of the fuser assembly. The toner can also be transferred to the pressure roll, particularly after a pause in printing when rotation of the pressure and fuser rolls is recommenced. The toner is transferred from the pressure roll to the back side of the first copy and leads a user to request a servicing of the printer.

CROSS REFERENCE TO RELATED PATENTS AND APPLICATIONS

The following references, the disclosures of which are incorporated herein in their entireties by reference, are mentioned:

U.S. application Ser. No. 11/314,847, filed contemporaneously herewith, entitled "MULTIVARIATE PREDICTIVE CONTROL OF FUSER TEMPERATURES," by Pieter Mulder, et al.

U.S. application Ser. No. 11/314,253, filed contemporaneously herewith, entitled "REUSABLE WEB CLEANING SYSTEM FOR A FUSER," by John Poxon, et al.

INCORPORATION BY REFERENCE

The following references, the disclosures of which are incorporated herein in their entireties by reference, are mentioned:

U.S. Pat. No. 5,049,944 to DeBolt, et al. and U.S. Pat. No. 6,876,832 to Pirwitz, et al. disclose web cleaning systems for a fuser apparatus.

U.S. Pat. No. 3,831,553 to Thettu discloses an apparatus for lubricating a heated fuser roll. The apparatus includes an applicator roll in contact with an oil supply and a wick, which contacts the fuser roll.

BRIEF DESCRIPTION

Aspects of the exemplary embodiment relate to an apparatus, to a fuser system and to a method of operating such a system.

In one aspect, an apparatus includes a web, which extends between a rotatably mounted supply roll and a driven take up roll. A cylindrical member is rotatable about an axis of rotation. A tension roll biases the web, intermediate the supply roll and take up roll, into contact with the cylindrical member, during rotation of the cylindrical member. A displacement system displaces the web, relative to the cylindrical member, in a first direction parallel to the axis of rotation of the cylindrical member.

In another aspect, a fuser system includes a fuser roll and a pressure roll being rotatably mounted parallel to an in contact with each other to form a nip through which print media with a toner image thereon is passed to fuse the image to the print media. A web contacts the fuser roll. A drive system advances the web in a first direction. A system is provided for laterally displacing the web, relative to the fuser roll, in a second direction, the second direction being angularly spaced from the first direction.

In another aspect, a method includes advancing a web such that a portion of the web in contact with a rotating cylindrical member is shifted along the web in a first direction. The web is displaced in a second direction, angularly spaced from the first direction, such that the portion of the web in contact with the cylindrical member is axially displaced relative to the cylindrical member.

DETAILED DESCRIPTION

In aspects of the exemplary embodiment disclosed herein, an apparatus, such as a fuser system, includes a cleaning web which extends between a supply roll and a driven take up roll. The web is biased into contact with a rotating cylindrical member, such as a fuser roll, as the fuser roll is rotated about its axis of rotation. A lateral displacement system displaces the web, relative to the fuser roll, in a direction generally parallel to the axis of rotation of the fuser roll, whereby regions of the web which have become contaminated with collected toner are shifted laterally, thus avoiding oversaturation of the web.

Figure 1:
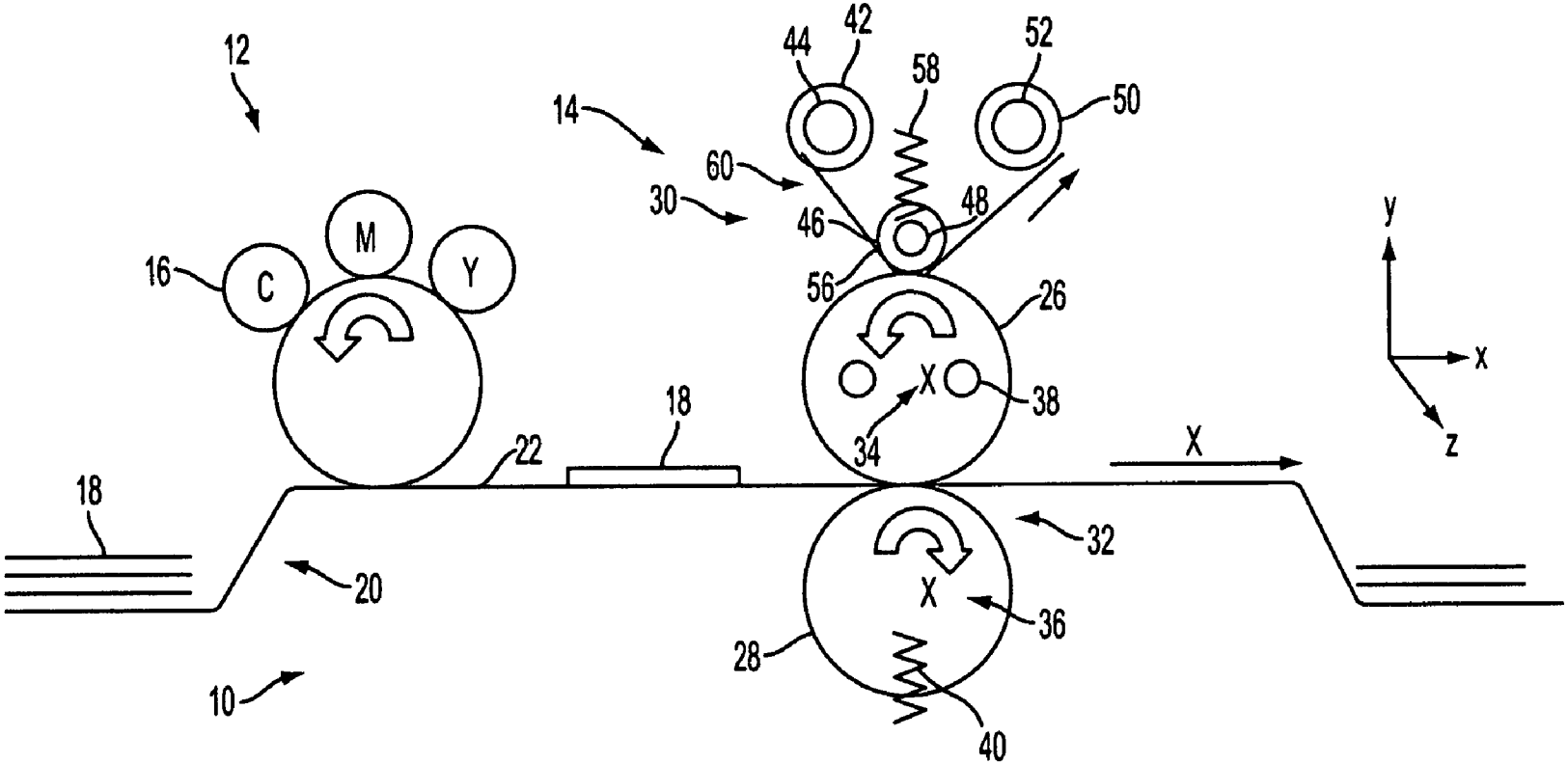
FIG. 1 is a schematic view of a printing system according to the exemplary embodiment.

With reference to FIG. 1, an electrophotographic printing system 10 includes an image applying component 12, which applies a toner image to print media by the steps of latent image formation, development, and transfer, and a fusing system 14, which fuses the applied image to the print media. The image applying component 12 includes one or more toner sources 16, such as cyan, magenta, and yellow (C, M, and Y) in the illustrated embodiment, and may employ conventional xerographic techniques, as known in the art. Print media 18 is conveyed to the image applying component 12 from a print media source 20 by a conveyor system 22. The conveyor system 22 also transports print media with toner images thereon from the image applying component 12 to the fusing system 14 in the processing direction, indicated by arrow x. The exemplary printing system 10 may include a variety of other components, such as finishers, paper feeders, and the like, and may be embodied as a copier, printer, bookmaking machine, facsimile machine, or a multifunction machine.

"Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. A "finisher" can be any post-printing accessory device, such as a tray or trays, sorter, mailbox, inserter, interposer, folder, stapler, stacker, hole puncher, collater, stitcher, binder, envelope stuffer, postage machine, or the like. The operation of applying images to print media, for example, graphics, text, photographs, etc., is generally referred to herein as printing or marking.

The fusing system 14 (or simply "fuser") generally includes a fuser roll 26, a pressure roll 28, and a web cleaning system 30. The fuser roll 26 and pressure roll 28 are rotatably mounted in a fuser housing (not shown) and are aligned parallel to and in contact with each other to form a nip 32 through which the print media, such as paper 18, with a toner image thereon (not shown) is passed, as in the direction of arrow x. The fuser roll and pressure roll are rotated about respective axes of symmetry 34, 36 aligned generally perpendicular with the process direction, in the direction of arrow z. The fuser roll 26 is heated by a heating system 38, illustrated as a pair of heat lamps aligned parallel to the axis 34 of the fuser roll 26. A drive system (not shown) rotates the fuser and pressure rolls 26, 28 in the directions shown in FIG. 1. For example, the fuser roll may be driven at about 300 mm per second. The pressure roll 28 is urged into contact with the fuser roll 26 by a constant spring force, indicated by arrow 40.

The fuser roll 26 may include a rigid cylindrical sleeve, formed from aluminum or other suitable metal, that is hollow and has a wall thickness about 5 mm, or less. The pressure roll 28 may include a cylindrical conformable roll which includes a metal core, such as steel, with a layer of silicone rubber or other conformable material on its outer surface that is covered by a conductive heat resistant material, such as Teflon™. As the paper with the toner image is passed through the nip 32, the toner image melts and is permanently fused to the paper 18.

The web cleaning system 30 is spaced from the nip 32 and includes a supply roll 42, mounted on an axial shaft 44, a tension roll 46, mounted on an axial shaft 48, and a take up roll 50, mounted on an axial shaft 52, all of which are rotatably mounted parallel to each other and to the longitudinal axes 34, 36 of the fuser and pressure rolls 26, 28. The tension roll 46 is urged into contact with the fuser roll 26 to form a nip 56 by a biasing member, such as by one or more springs 58. The supply and take up rolls 42, 50 have a web 60 wrapped and stored thereon. The tension roll 46 may consist of a cylindrically shaped core, formed of a conformable, heat resistant material, such as foam, formed on a steel shaft 48.

The replaceable web 60, which has the appropriate texture and toner cleaning characteristics, is mounted at ends thereof to the supply roll 42 and take up roll 50 and passes through the nip 56, so that the tension roll 46 presses the web 60 against the fuser roll 26. Any suitable web material capable of withstanding fusing temperatures of about 225° C. may be employed. The web material may be woven or non-woven, so long as it has a surface texture suitable to collect toner from the fuser roll 26 and has a sufficient thickness and strength to prevent the web 60 from being torn when the web is pulled through the nip 56. A typical web may be about 9 meters in length and relatively thin (about 40 μm). Nonwoven rayon, nylon and polyester, as well as some paper products are suitable for forming the web 60. The particular characteristics of any material selected will determine how fast the web may travel. The web 60 may be impregnated or contacted with a liquid, such as suitable lubricant/release agent, which is released on to the fuser roll 26. Suitable liquids include silicone oils.

Figure 2:
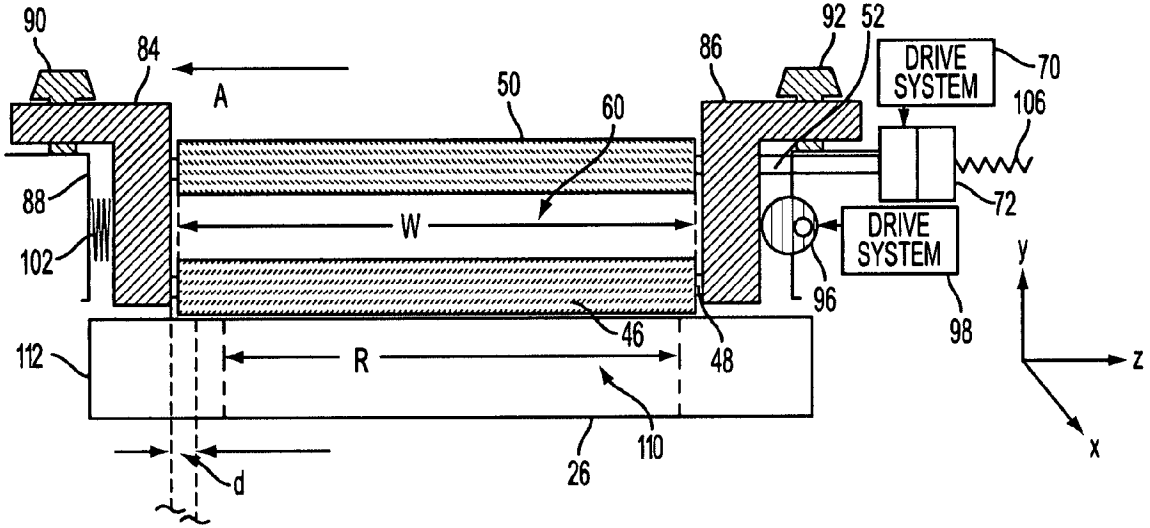
FIG. 2 is a cross sectional view of the fuser roll and web cleaning system of FIG. 1 in a first position.
Figure 3:
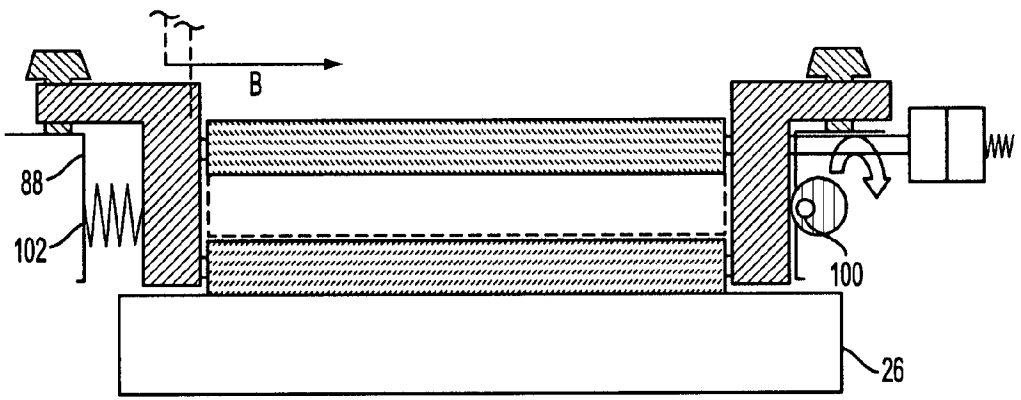
FIG. 3 is a cross sectional view of the fuser roll and web cleaning system of FIG. 1 in a second position.

With reference also to FIGS. 2 and 3, a first drive system 70 drives the take up roll 50 such that the web 60 is advanced in the direction shown in FIG. 1, from the supply roll 42 to the take up roll 50 (in the illustration of FIGS. 2 and 3, the supply roll is located behind the take up roll and thus is not seen). In particular, the drive system 70 is drivingly coupled to the shaft 52 via a drive member, such as a dog 72. Suitable drive systems 70 include electric motors, such as those which operate at a velocity which varies according to the diameter of wound up web on the driven (take up) roll 50. For example, a drive system 70 similar to that disclosed in U.S. Pat. No. 6,876,832 to DeBolt, et al., incorporated by reference, may be employed.

The web 60 is advanced by the drive system 70 at a relatively slow rate, as compared with the rotation speed of the fuser roll 26. For example, the take up roll 50 may be advanced at about 5 to 20 mm per 1000 copies, e.g., about 17 mm/1000 copies, which equates to about 0.1 revolutions of the take-up roll/minute. The web may be advanced continuously or incrementally, e.g. advanced a small increment after each copy or after a number of copies. In one embodiment, the lateral displacement of the web and advancement of the web occur contemporaneously.

At any given time, a portion of the web 60 within the nip 56 serves to collect toner and other materials which have deposited on the fuser roll 26. As the web advances in the nip 56 in the direction of arrow x (i.e., parallel to the process direction), a clean portion of the web is progressively brought in contact with the fuser roll 26. In addition to advancement, the web is shifted laterally generally in the z direction, relative to the fuser roll 26 (i.e., into/out of the page in FIG. 1) during rotation of the fuser roll. As shown in FIGS. 2 and 3, a lateral displacement system 80 periodically displaces the web 60 in a first direction, illustrated by arrow A, and in a second direction, illustrated by arrow B, opposite the first direction. Specifically, the displacement system 80 continuously or incrementally shifts the web 60 laterally by a distance d between a first lateral position shown in FIG. 2, and a second lateral position, shown in FIG. 3. The web 60 is displaced laterally (either continuously or incrementally) a distance d in a first direction between the first and second positions and then displaced laterally by distance d in an opposite direction. This cycle may be repeated multiple times as the web advances, until the entire web is taken up on the take up roll 50. In one embodiment, the distance d is at least about 2 mm, such as at least 5 mm and may be less than about 50 mm, such as less than about 20 mm. A lateral shift of about 7 to 10 mm is provided in one embodiment. In one embodiment, for every 5 mm advancement of the web, the web undergoes at least one lateral translation cycle in direction z, in which the web is displaced laterally about 7-10 mm in one direction and then displaced laterally about 7-10 mm in the opposite direction.

Although the direction in which lateral translation occurs is generally at about 90° to the direction of web advancement (an axial translation), the direction of lateral displacement can be in any direction angularly spaced from the advancement direction x which results in a lateral displacement of the web.

Various methods of shifting the web laterally are contemplated. For example, one or more of the supply roll 42, take up roll 50, and tension roll 46 is laterally translated on a cyclical basis. To reduce the likelihood of tearing the web 60 during lateral translation, in one embodiment, each of these elements 42, 46, 50 is translated as a unit.

FIGS. 2 and 3 show one exemplary embodiment of a system 80 for lateral displacement of the web, relative to the fuser roll 26. In the embodiment illustrated, the system 80 includes a moveable assembly 82 which includes the web take up roll 50, the web supply roll 42 (which is behind the web take up roll in FIG. 2) and the tension roll 46. The entire assembly 82 is shifted laterally, first in the direction of arrow A, then in the direction of arrow B. Specifically, the shafts 44, 52, and 48 of the rolls 42, 50, and 46, respectively are rotatably mounted, at ends thereof, to left and right web blocks 84, 86. The web blocks 84, 86, in turn, are moveably mounted to the frame 88 of the fuser housing at laterally spaced locations by shoulder screws 90, 92 received in slots (not shown) in the web blocks and frame, which permit lateral movement (in the z direction) of the web blocks 84, 86 relative to the frame 88 while constraining movement in other directions. For example, web block slots may extend laterally.

The moveable assembly 82 translates laterally, as a unit, relative to the fuser roll 26. Specifically, an eccentric rotating cam 96 is mounted adjacent one of the web blocks 86. The cam 96 may be rotated by a drive system 98, such as a motor, which is drivingly connected to an eccentric shaft 100 of the cam. Due to the throw of the cam, which may be about 7-10 mm, the assembly 82 is periodically translated laterally from the position shown in FIG. 2 to that shown in FIG. 3, and back again. The cam 96 engages the right web block 86, and its eccentricity is converted to the movement of the assembly 82. A bias spring 102 adjacent the left web block 84 biases the assembly 82 laterally toward the cam 96 to maintain a spring load on the assembly 82. The web take up roll motor 70 maintains rotation of the drive shaft 52 during axial translation of the assembly 82. In the illustrated embodiment, the drive dog 72 is spring loaded, e.g., by a bias spring 106, so that the drive dog communicates rotational force from the motor 70 to the drive shaft during lateral translation.

The speed of axial translation may be selected to provide about 0.01 to about 1 mm of translation per copy, e.g., about 0.05 to 0.5 mm per copy. In one embodiment, the web translates axially at about 0.1 to 0.3 mm per copy. For example, for a lateral translation of 0.1 mm/copy, and a throw of 10 mm, the motor may turn the shaft 100 about one revolution every 200 copies. For a 50 print per minute printer, this amounts to about 0.25 rpm.

It will be appreciated that other systems for lateral translation of the web may be implemented. Additionally, while two separate drive systems 70, 98 are illustrated, a single drive system may be drivingly coupled to both the drive shaft 52 and the cam 96 for rotation of both these components.

The web 60 has a width w which is wider than a width R of an image area 110 of the toner image on the fuser roll 26. The width R corresponds to the width of the fuser roll in which toner contamination may occur and generally corresponds to the imaged width of the print media. In particular, w is at least R+d. In this way, as the web translates, a portion of the web is always in contact with the image area in the nip 56.

In the illustrated embodiment, the lateral displacement d is no greater than a distance s between the web 60 and an adjacent end 112 of the fuser roll 26, such that the web at no time overlaps the fuser roll.

Figure 4:
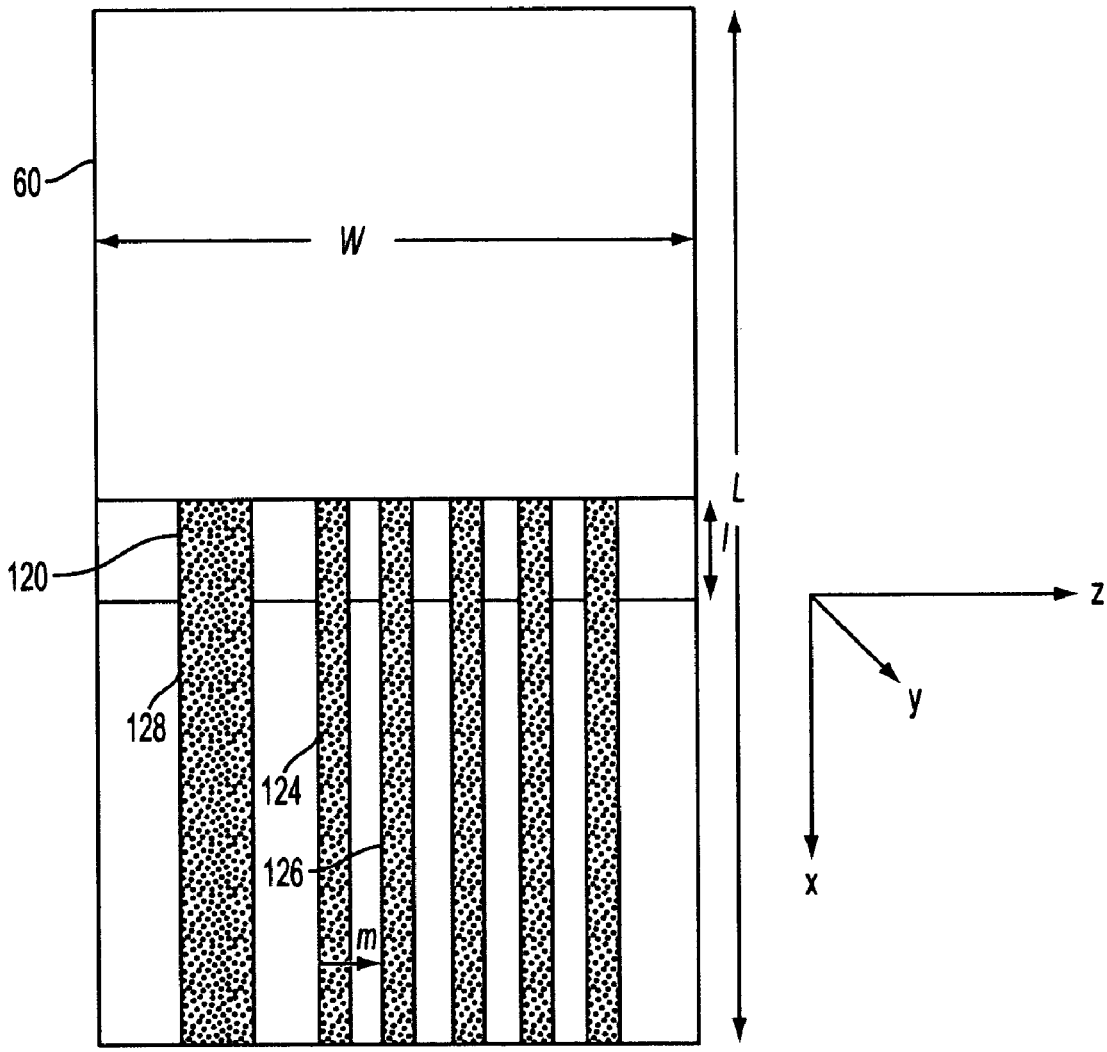
FIG. 4 is a schematic view of a portion of a web in a conventional web cleaning system during printing.
Figure 5:
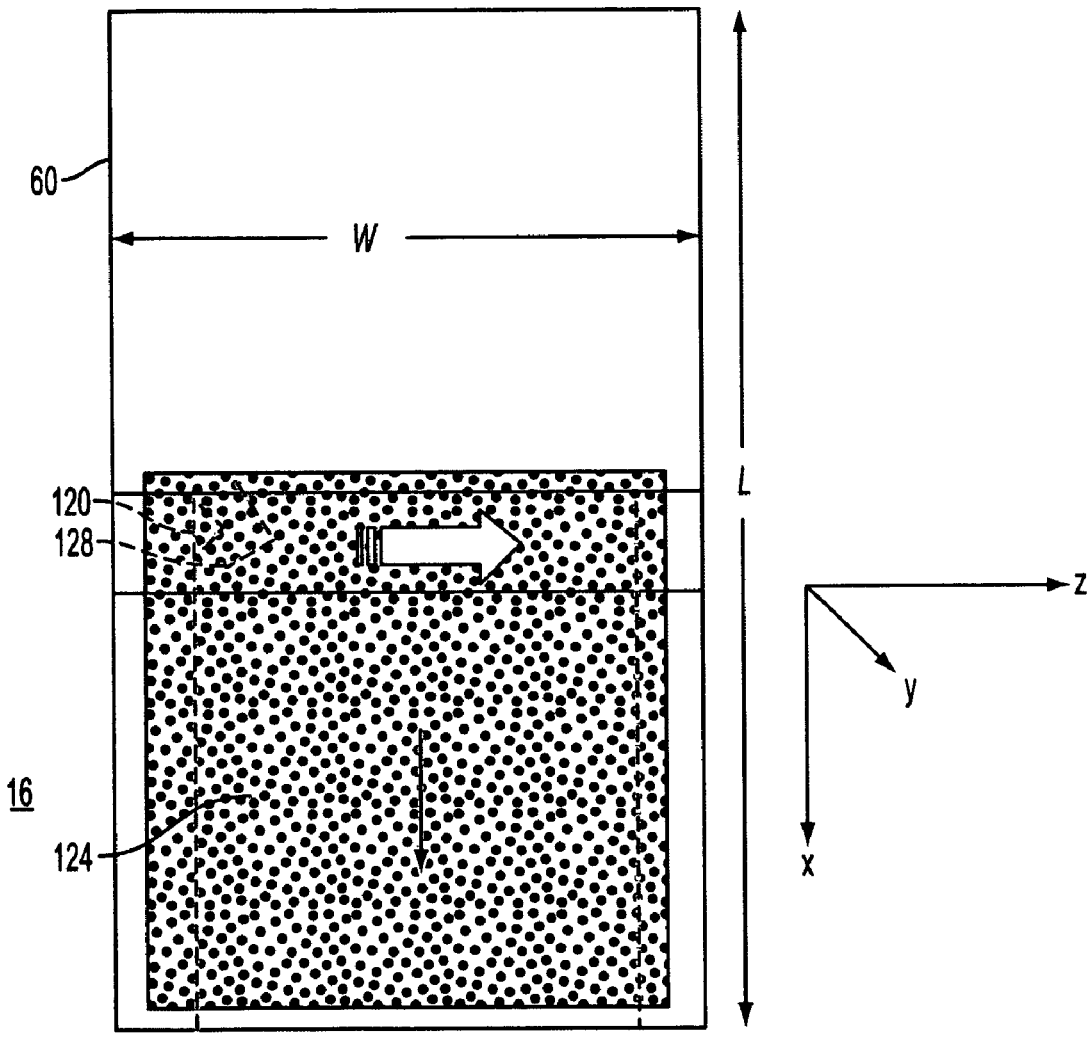
FIG. 5 is a schematic view of a portion of a web in the exemplary web cleaning system during printing.

FIGS. 4 and 5 illustrate the accumulation of toner contamination on the web 60 during advancement in a conventional web cleaning system (FIG. 4) and in the present system (FIG. 5). The web 60 has its longest dimension or length L in the process direction (x) and its shortest dimension or width w in the cross process direction (z), i.e., generally parallel to the longitudinal axis 34 of the fuser roll. A portion 120 of the web 60 which is within the nip 56 at a particular time forms an active web nip area for absorbing contamination from the fuser roll 26. The length/of portion 120 depends to some degree on the conformability of the tension roll 48 and the pressure applied by biasing member 58, and is typically about 5 mm.

As illustrated in FIG. 4, when multiple copies of the same image are printed, or when text pages are printed, the web 60 is primarily contaminated in strips 124, which may correspond to the areas of text in the image. In the conventional web cleaning system of FIG. 4, these areas may become oversaturated and, as a result, toner may be transferred back to the fuser roll 26 from the web cleaning system. The strips 124 are spaced by areas 126 of little or no contamination, corresponding to the spaces between the lines of text. These portions of the web are essentially wasted. A header at the top of the image may generate a strip 128 which is particularly prone to saturation.

In the present system, the lateral displacement of the web results in a more even coverage of the web, as shown in FIG.

5. In this way, no region of the web becomes oversaturated, and thus there is significantly less likelihood of transfer of toner back to the fuser roll.

In one embodiment, at least one complete lateral displacement cycle is completed in the time the web travels the length of portion 120. In specific embodiments, the lateral displacement cycles are more rapid, such as two to five or more cycles in the time the web travels the length of the nip portion 120, or two to five times in the time it takes for the web to advance about 5-20 mm.

The distance d may be a function of the typical spacing between lines of text. For example, d may be at least about the typical spacing between lines of text or greater. Long jobs in which electronic documents with the same or similar line spacing and layout are printed (such as those with email headers, text lines, tables, etc.) result in less short-term saturation of the web in the exemplary system.

It will be appreciated that the displacement of the web may be in stepped increments or continuous. In the case of a stepped displacement, the displacement distance may be sufficient to place a second set of contamination strips intermediate, e.g., midway between the first set 124, or some other suitable increment. In this way the contamination is spread over a larger area of the web and the likelihood of oversaturation of the web is reduced. For example, where the distance between lines of text in the image is m mm, the distance d can be N m+f, where N is zero or an integer and f is less than m. For example, if the text line spacing is 4 mm and the width of each strip of text is 1.5 mm, f may be about 2 mm. Thus d may be, for example, 2 mm, 6 mm, 10 mm, etc, depending on the value of N selected. In the case of a gradual, e.g., substantially continuous or incremental displacement, the total displacement d may be any amount, and can be equal to or greater than the line spacing m. In this way, the contamination is spread relatively evenly over the web.

In the present system, the web may be run at a lower speed than in the conventional system, without increasing the likelihood of toner retransfer. As a result, the web is replaced less frequently.

The illustrated web cleaning system 80 is shown in association with the fuser roll 26. In some systems, the web cleaning system may be used to remove toner from the pressure roll 28, or other rotating cylindrical member.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method comprising:

advancing a web such that a portion of the web in contact with a rotating cylindrical member is shifted along the web in a first direction between a supply roll and a take up roll, the advancing being at a slow rate compared with a rotation speed of the rotating cylindrical member, said cylindrical member forming a nip with a second cylindrical member through which sheets pass; and displacing the web during rotation of the rotating cylindrical member in a second direction, angularly spaced from the first direction, such that a portion of the web in contact with the rotating cylindrical member is axially displaced relative to the rotating cylindrical member, an axial translation of the web being no more than about 1 mm per each one of said sheets passing through the nip.

2. The method of claim 1, further comprising:

displacing the web in a direction opposite the first direction.

3. An apparatus comprising:

a cylindrical member which is rotatable about an axis of rotation as sheets pass through a nip;

a web which extends between a rotatably mounted supply roll and a driven take up roll and which is advanced between the supply roll and take up roll to provide a clean web surface in contact with a surface of the cylindrical member to be cleaned;

a tension roll which biases the web intermediate the supply roll and take up roll into contact with the cylindrical member during rotation of the cylindrical member; and a displacement system which displaces the web, relative to the cylindrical member, in a first direction parallel to the axis of rotation of the cylindrical member, the displacement system providing axial translation of the web of no more than about 1 mm per each one of said sheets passing through the nip, whereby a more even coverage of the web with toner is achieved than without said displacement.

4. The apparatus of claim 3, wherein the displacement system displaces the web in a second direction, opposite the first direction.

5. The apparatus of claim 4, wherein the displacement is repeated periodically.

6. The apparatus of claim 3, wherein the web carries an oil which is transferred to the cylindrical member.

7. The apparatus of claim 3, wherein the system for laterally displacing the web displaces the web, relative to the cylindrical member, by a distance which is less than a distance between the web and an end of the cylindrical member.

8. The apparatus of claim 3, wherein the lateral displacement of the web displaces the web by a distance of at least 5 mm.

9. The apparatus of claim 3, wherein the system for laterally displacing the web is operatively coupled to at least one of the supply roll, the take up roll, and the tension roll.

10. A fuser system comprising the apparatus of claim 3, the cylindrical member being a fuser roll, and a pressure roll being rotatably mounted parallel to and in contact with the fuser roll to form the nip through which print media with a toner image thereon is passed to fuse the image to the print media.

11. The fuser system of claim 10, wherein the system for lateral displacement periodically displaces the web in the second direction and in a direction opposite the second direction.

12. The system of claim 10, wherein the system for laterally displacing the web displaces the web by a distance of at least 5 mm in the second direction.

13. The system of claim 10, wherein the system for laterally displacing the web displaces the web by a distance of less than about 20 mm in the second direction.

14. The fuser system of claim 10, wherein the second direction is aligned with an axis of the fuser roll.

15. The fuser system of claim 10, wherein the fuser system includes a supply roll and a take up roll and wherein the drive system advances the web from the supply roll to the take up roll.

16. The fuser system of claim 15, wherein the system for lateral displacement laterally displaces the supply roll and the take up roll.

17. The fuser system of claim 15, wherein the system for lateral displacement includes a web block which supports the web adjacent a first side thereof, a cam which engages the web block, and a drive system for driving the cam so as to provide a lateral movement of a web block.

18. The fuser system of claim 17, further comprising a second web block which supports the web adjacent a second side thereof and a biasing mechanism which biases the second web block towards the cam.

19. The fuser system of claim 15, wherein the take up roll, supply roll, and tension roll, are laterally translated as a unit.

20. The fuser system of claim 10, wherein each displacement of the web in the second direction is accompanied by an advancement of the web in the first direction.

* * * * *